US005832544A

United States Patent [19]

Pan

[11] Patent Number: 5,832,544

[45] Date of Patent: Nov. 10, 1998

[54] SINK DRAIN STOPPER

[76] Inventor: Chin-Chi Pan, No 99, Sec. 3, Chang Tsao Rd., Ho Me, Changhua, Taiwan

[21] Appl. No.: 998,681

[22] Filed: Dec. 29, 1997

[51] Int. Cl.[6] ..... A47K 1/14

[52] U.S. Cl. ..... 4/293; 4/286; 4/295

[58] Field of Search ..... 4/286, 287, 293, 4/295

[56] References Cited

U.S. PATENT DOCUMENTS

| | | | |
|---|---|---|---|
| 4,926,507 | 5/1990 | Craig et al. | 4/295 |
| 5,072,461 | 12/1991 | Logsdon | 4/295 |
| 5,749,105 | 5/1998 | Bruno et al. | 4/295 |

*Primary Examiner*—Charles E. Phillips
*Attorney, Agent, or Firm*—W. Wayne Liauh

[57] ABSTRACT

A sink drain stopper has a main body provided therein with a cover body capable of rising and descending. The cover body is provided in the top thereof with a pull head. A center rod is located in the extension of the cover body by a bolt such that the center rod is fastened at the bottom end thereof with the main body. The cover body is raised or descended by rotating the cover body such that the bolt is moved on the center rod. The cover body is provided therein with a washer to avert the water leak. The cover body, the center rod and the main body can be easily dismantled for cleaning or replacing.

1 Claim, 9 Drawing Sheets

SINK DRAIN STOPPER

FIELD OF THE INVENTION

The present invention relates generally to a stopper, and more particularly to a sink drain stopper.

BACKGROUND OF THE INVENTION

As shown in FIG. 1, a chain stopper of the prior art consists of a tapered body 1 and a chair 2 which is fastened at one end thereof with the tapered body 1 and at another end thereof with a sink. The body 1 is dimensioned to fit into the drain of the sink. The prior art chain stopper described above is defective in design in that it can be inadvertently stuck in the drain.

There is another prior art stopper which is called pop-up stopper, as shown in FIGS. 2 and 3. The stopper has a cover body 3 provided at the top thereof with a pull head 31 and in the midsegment thereof with a leakproof ring 4. The cover body 3 is further provided with a tapered portion 32 and a hollow extension 33 which is in turn provided with a screw 5. A center rod 6 is located in the extension 33 of the cover body 3 and is provided with a slot 61 and a groove 62 for locating the screw 5 so as to locate the cover body 3 at such time when the cover body 3 is moved upward or downward. The center rod 6 is provided at the bottom thereof with a threaded portion 63 which is engaged with the threaded hole 71 of a main body 7 for locating the cover body 3 at the top of the main body 7. The main body 7 is provided at the water outlet thereof with a tapered face 72 corresponding in location to the tapered portion of the cover body for stopping the water outlet of the main body 7 at such time when the cover body 3 is lowered. In the process of assembling the cover body 3, a gap is likely to form between the leakproof ring 4 and the tapered face 72 of the main body 7 if the threaded hole 71 of the main body 7 and the center of the inner diameter of the tapered face 72 are not concentrical. As a result, the process of making the stopper is complicated and expensive. In addition, it is difficult to dismantle the stopper to get rid of the debris deposited in the stopper in view of the fact that a hand tool 8 must be used to disengage the screw 5 of the extension 33 of the cover body 3. It is difficult for a person to maneuver in a very limited space of the sink to disengage the screw 5 with the hand tool 8.

The primary objective of the present invention is to provide a sink drain stopper, which is composed of a main body, a cover body, a center rod, a pull head, and a washer. The main body is fastened with a sink for mounting the cover body which is provided at the top thereof with the pull head, and at the bottom with a bolt for retaining the center rod which is in turn fastened at the bottom end thereof with the underside of the main body. As the cover body is rotated, the bolt is raised on the center rod to urge or retain a planar surface or a position restricting slot of the center rod, thereby enabling the cover body to be raised or lowered. The washer is located at the underside of the cover body. When the cover body is lowered to stop the water, the weight of the cover body and the pressure of water cause the underside of the washer to become intimately attached to the main body so as to avert the water leak. As a result, the concentricity of the threaded hole of the cover body and the center of the inner diameter of the main body is eliminated such that the process of making the stopper of the present invention is relatively cost-effective. The center rod is provided at the end thereof with a slot for cooperating with movable pull head located at the top of the cover body. When the component parts of the stopper are to be cleaned or replaced, the center rod can be rotated to become disengaged with the main body such that both cover body and the center rod are dismantled together without having to use a hand tool.

Another objective of the present invention is to provide the sink drain stopper with the pull head which is provided at the lower segment thereof with a threaded portion engageable with a stepped hole of the cover body. As a result, the pull heads of various forms may be installed by the consumers.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
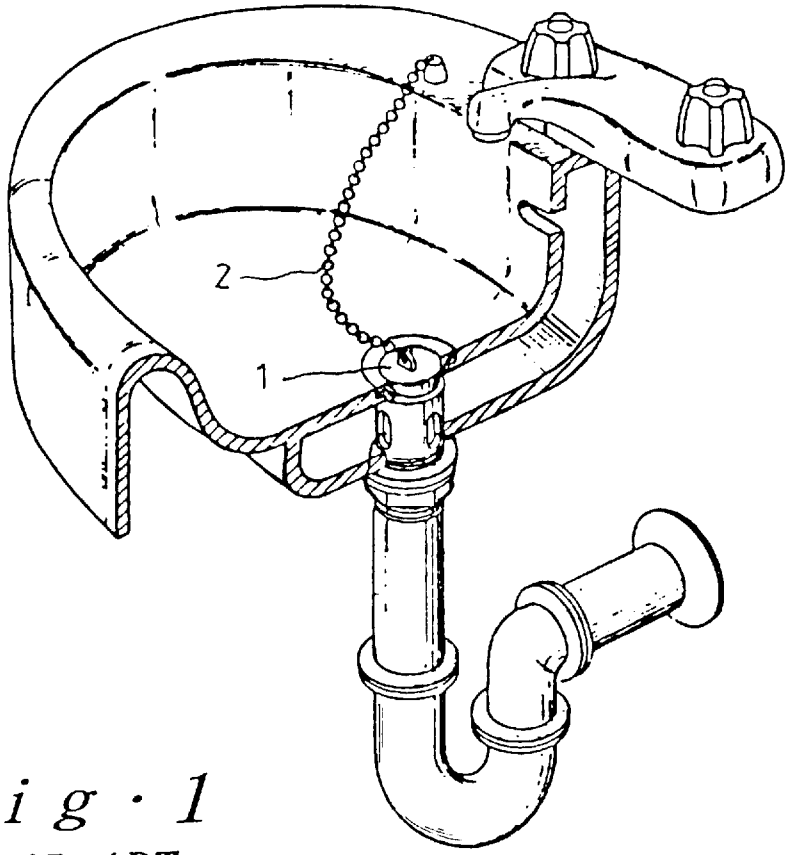
Fig. 1 PRIOR ART
FIG. 1 shows a schematic view of a chain stopper of the prior art.
Figure 2:
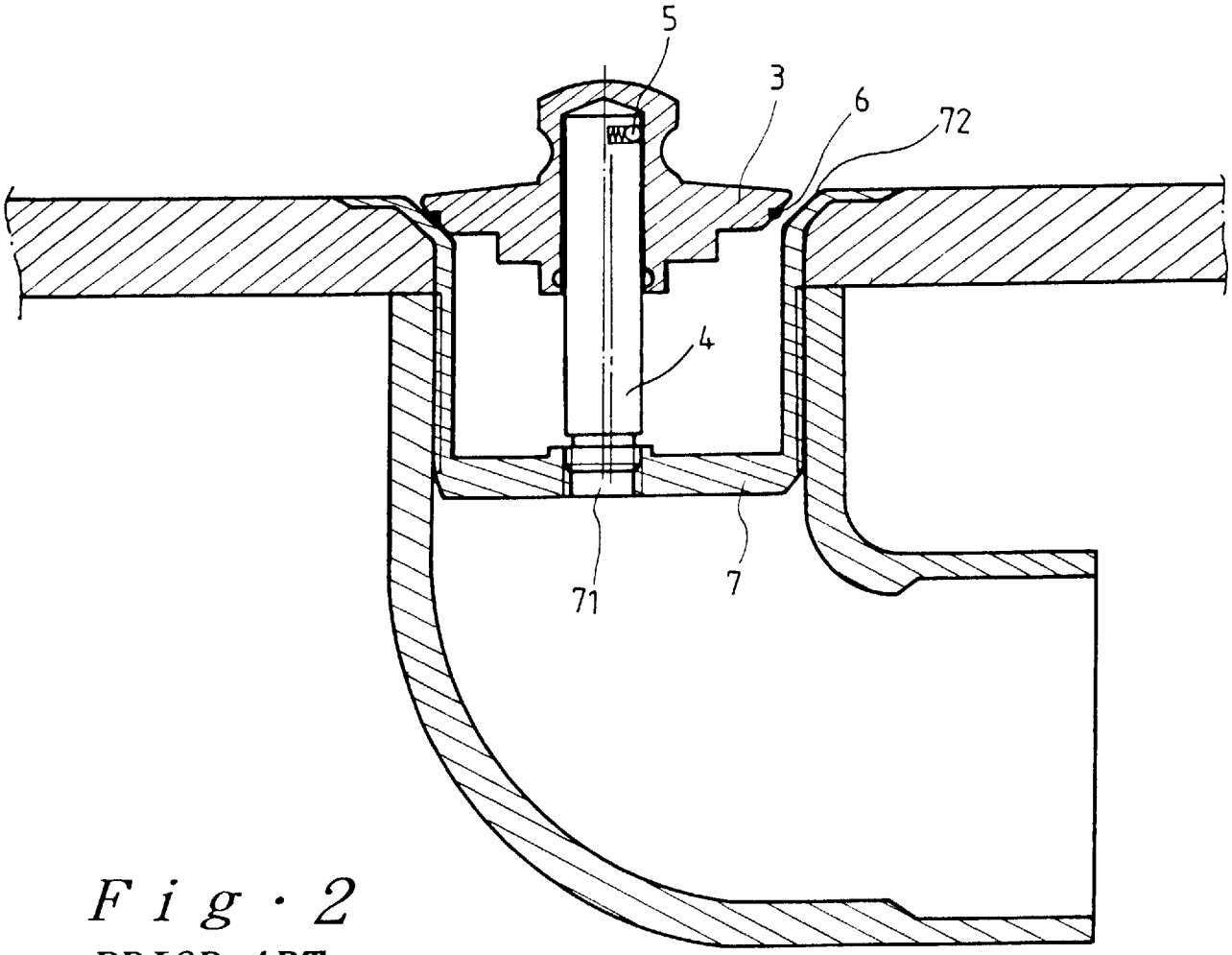
Fig. 2 PRIOR ART
FIG. 2 shows a schematic view of a pop-up stopper of the prior art.
Figure 3:
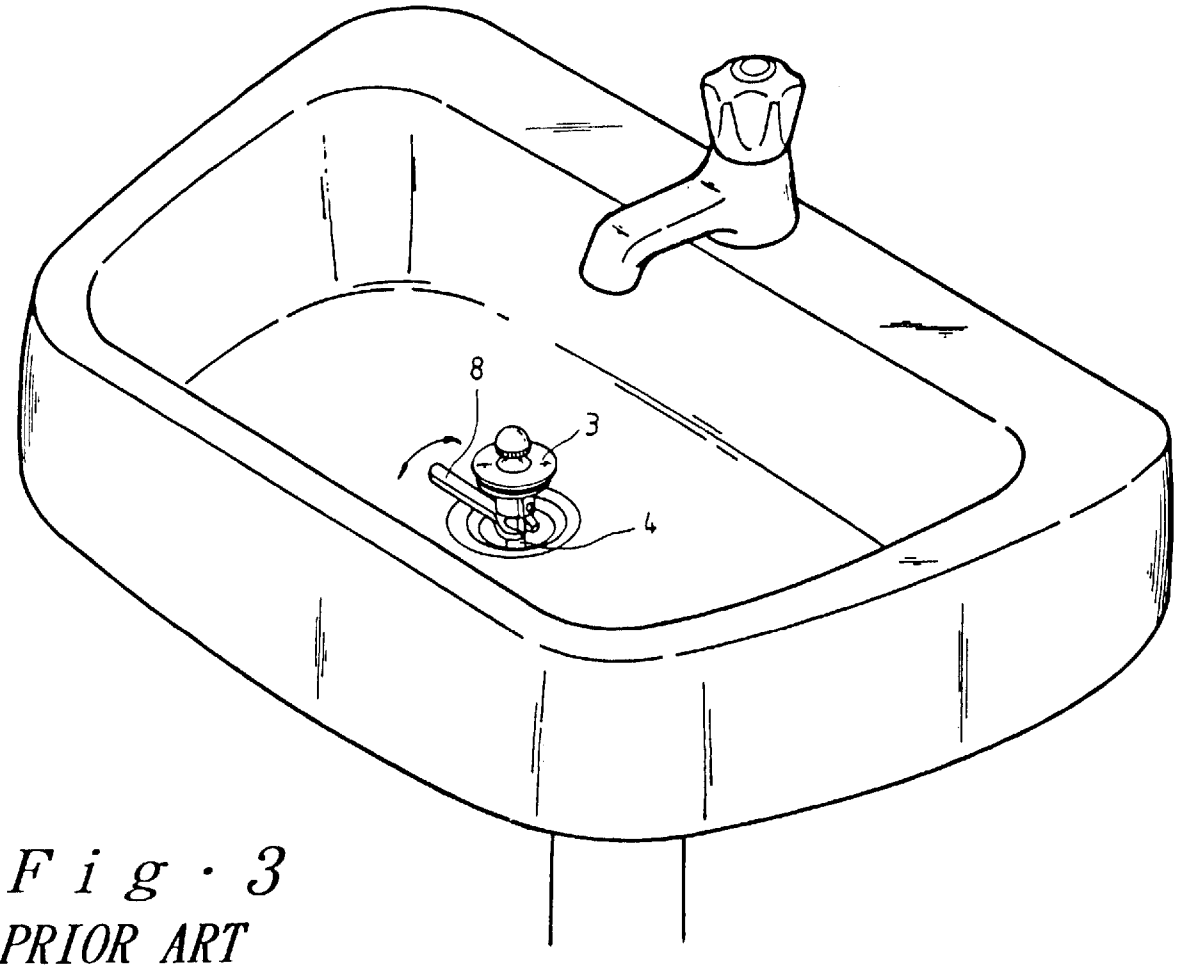
Fig. 3 PRIOR ART
FIG. 3 shows a schematic view of the prior art pop-up stopper at work.
Figure 4:
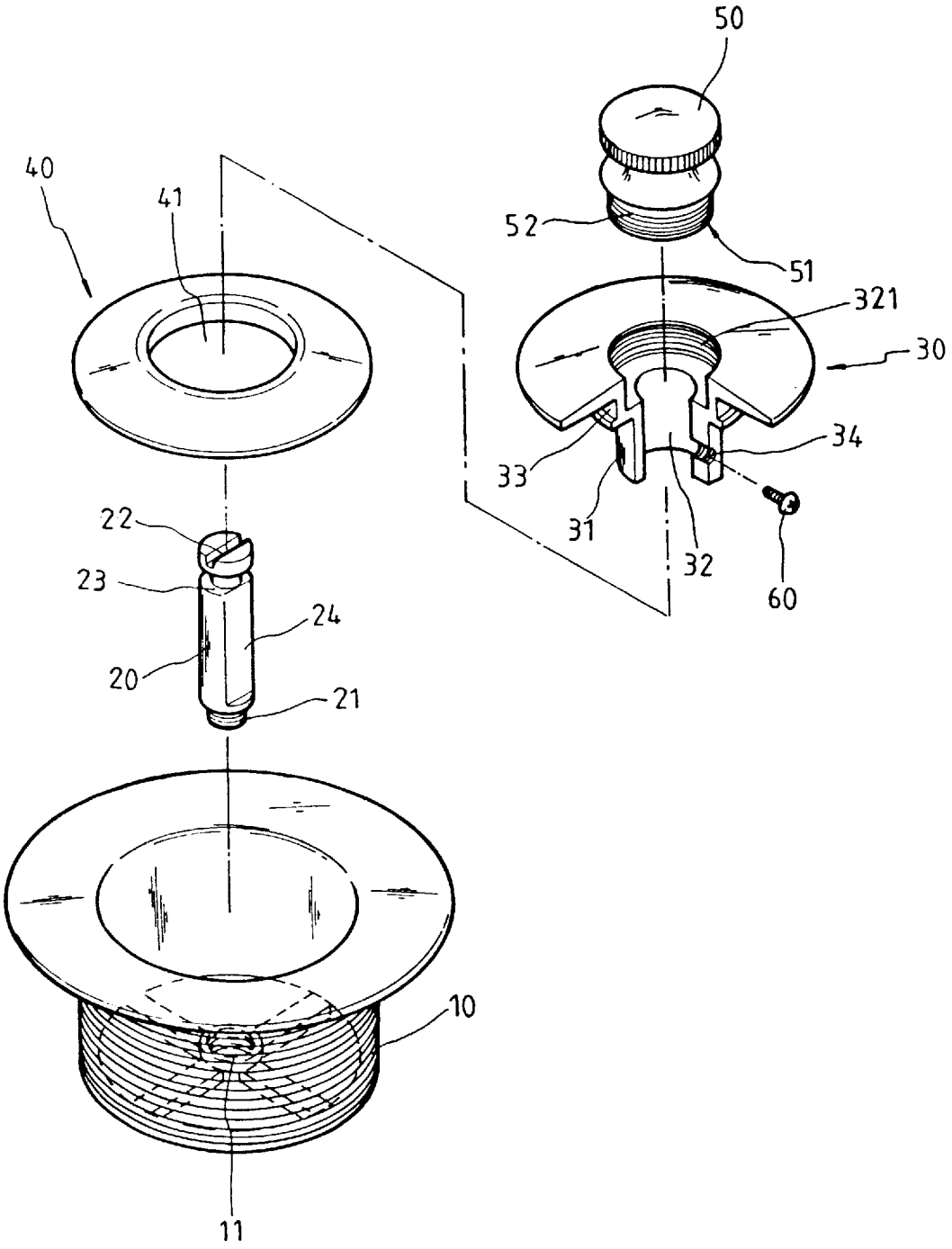
FIG. 4 shows an exploded view-of a sink drain stopper of the present invention.
Figure 5:
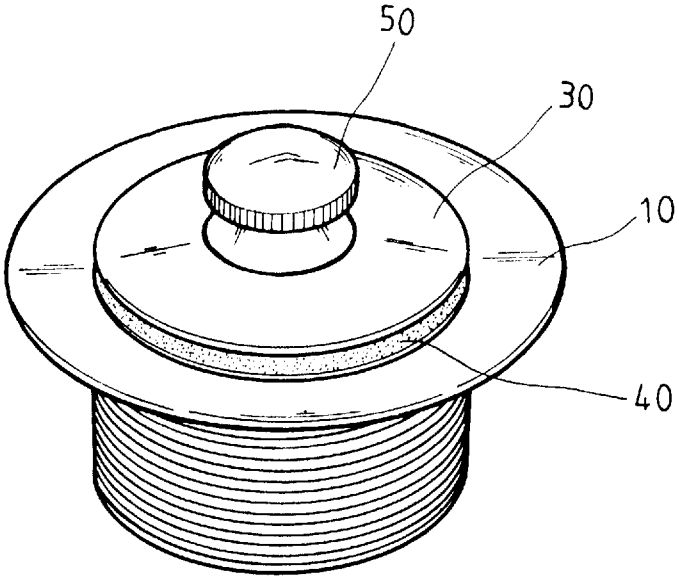
FIG. 5 shows a schematic view of the present invention in combination.

As show in FIGS. 4, 5, 6, and 8, a sink drain stopper of the present invention is composed of the component parts, which are described hereinafter.

A main body 10 of a hollow construction is fastened with a sink 70 and is provided in the underside thereof with a plurality of ribs and a threaded hole 11.

A center rod 20 is provided at one end thereof with a threaded portion 21 engageable with the threaded hole 11 of the main body, and in the top of another end thereof with a slot 22. The center rod 20 is further provided in the upper segment thereof with a position restricting slot 23, and is the side of the rod body thereof with a planar surface 24.

A cover body 30 is located on the top of the main body 10 and provided in the underside thereof with an extension 31 and a stepped hole 32. The stepped hole 32 is provided in the upper section thereof with an inner threaded hole 321. A locating slot 33 is extended from the extension 31 to the inner underside of the cover body 30. The extension 31 is provided in the side thereof with a threaded hole 34 engageable with a bolt 60.

A washer 40 is provided with a through hole 41 and is retained in the locating slot 33 of the cover body 30.

A pull head 50 is provided therein with a receiving cell 51 and is further provided in the bottom thereof with a threaded portion 52 engageable with the stepped hole 32 of the cover body 30.

The main body 10 is fastened with a lavatory 70, without the deficiency of the prior art calling for the precise alignment of the center of the inner diameter of the main body with the center of the threaded hole. The washer 40 of the present invention is provided with a through hole 41 for locating in the locating slot 33 of the cover body 30. The center rod 20 is located in the cover body 30 such that the threaded portion 21 of the center rod 20 is engaged with the threaded hole 11 of the main body 10.

Figure 6:
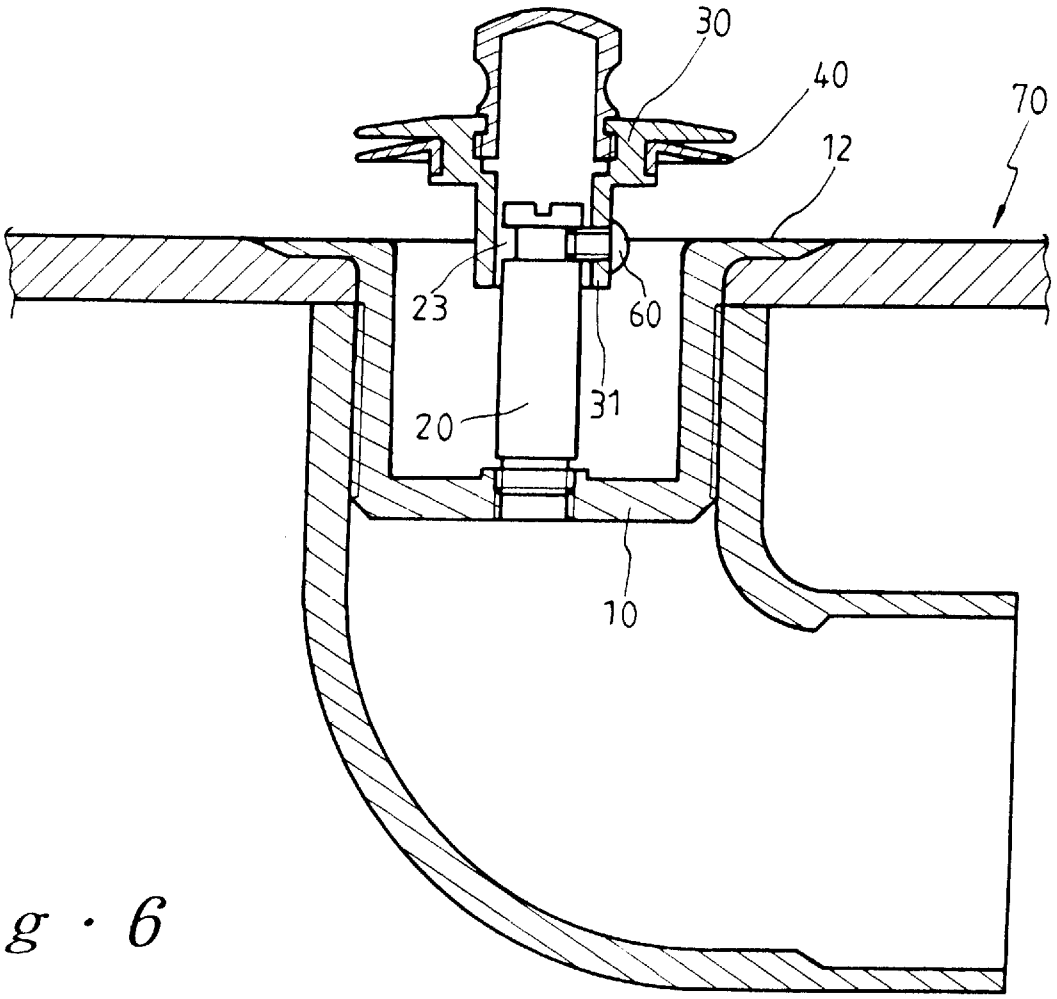
FIG. 6 shows a schematic view of the present invention at work.

As shown in FIG. 6, the water kept in the lavatory is let go when the cover body 30 is raised and rotated such that the bolt 60 is moved from the planar surface 24 of the center rod 20 to the position restricting slot 23 in which the bolt 60 is retained so as to locate the cover body 30 at the open position to drain the water. In the meantime, the washer 40 is disengaged with the circular face 12 of the main body 10 to allow the water to flow through the main body 10.

Figure 7:
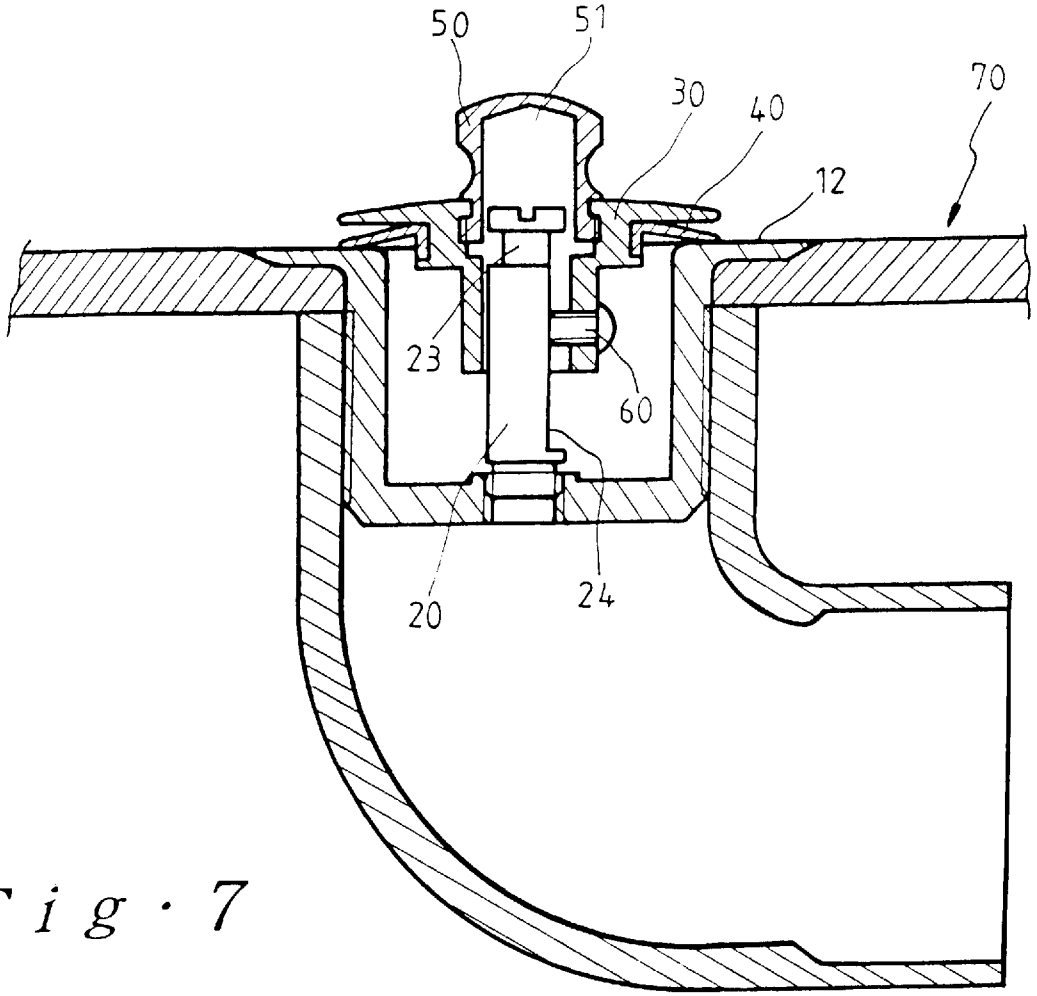
FIG. 7 shows another schematic view of the present invention at work.

Now referring to FIG. 7, the water is kept in the lavatory 70 by rotating the cover body 30 such that the bolt 60 is moved from the position restricting slot 23 to the planar surface 24, and that the cover body 30 is moved away from the position restricting slot 23 to descend, thereby enabling the center rod 20 to be received in the receiving cell 51 of the pull head 50. In the meantime, the washer 40 is once again in contact with the circular face 12 such that the washer 40 is under the pressure of the weight of the cover body 30 and the pressure of water, thereby forcing the underside of the washer 40 to become intimately attached to the circular face 12 of the main body 10.

Figure 8:
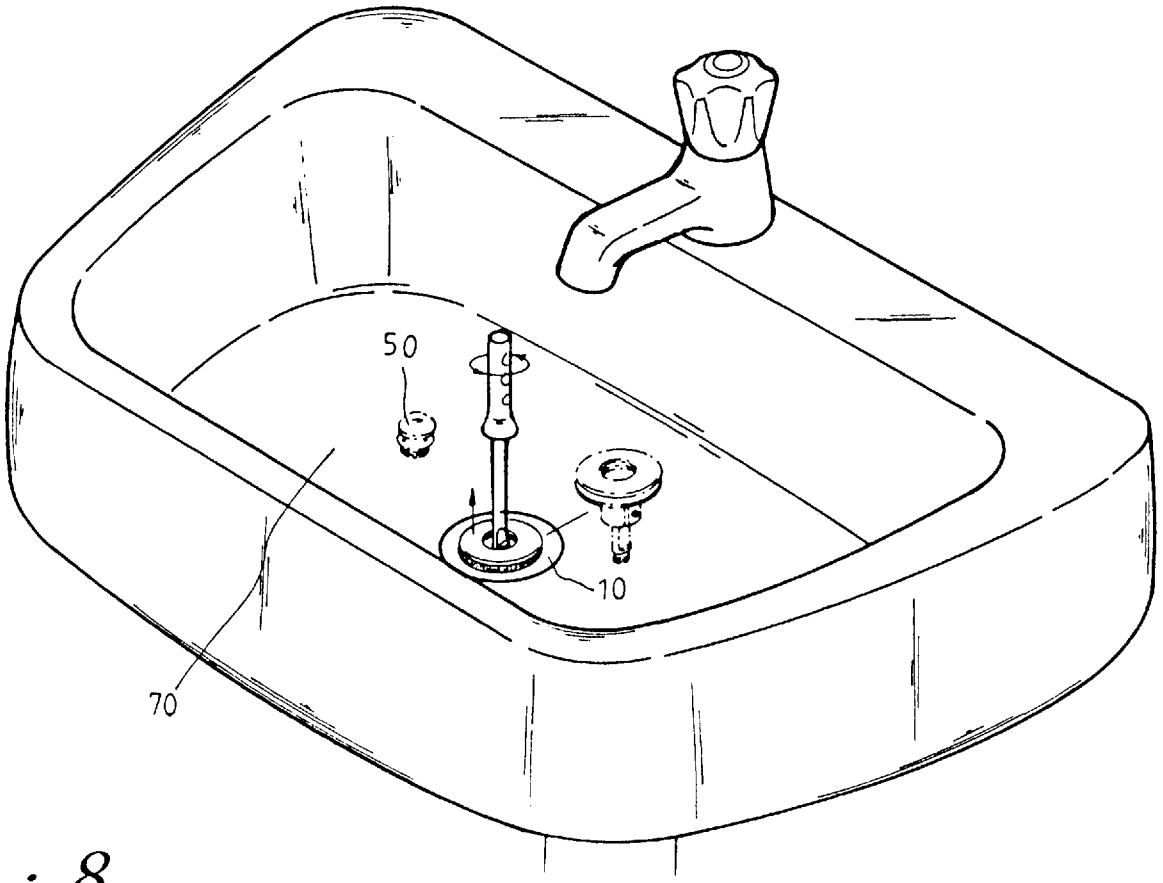
FIG. 8 is a schematic view showing the removal of the cover body of present invention.

As illustrated in FIG. 8, the stopper of the present invention can be easily dismantled for cleaning or replacing the component parts of the stopper. In the first place, the pull head 50 is rotated such that the pull head 50 is disengaged with the cover body 30. With the help of a hand tool, the center rod 20 can be disengaged with the main body 10 by locating vertically the hand tool in the slot 22 of the center rod 20 and then rotating the center rod 20 with the hand tool to cause the threaded portion 21 of the center rod 20 to disengage the threaded hole 11 of the main body 10.

Figure 9:
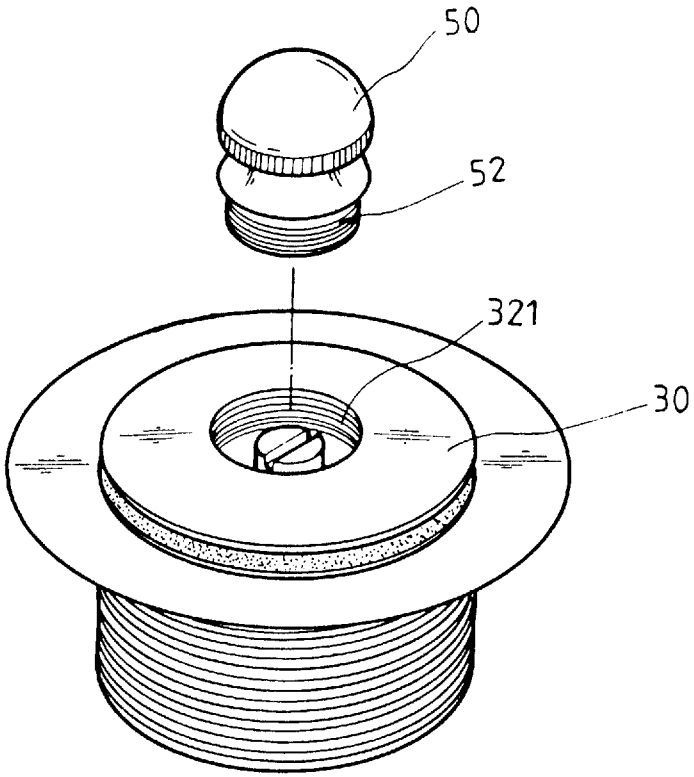
FIG. 9 is a schematic view showing the replacement of the pull head of the cover body of the present invention.

As illustrated in FIG. 9, the pull head 50 of the present invention is provided at the bottom thereof with the threaded portion 52 engageable with the threaded hole 321 of the cover body 30. As a result, the pull heads 50 of various forms can be selectively fastened with the cover body 30 for giving an added esthetic feature to the stopper of the present invention as well as the lavatory 70.

The stopper of the present invention has several advantages, which are elaborated hereinafter.

The stopper of the present invention is cost-effective in view of the fact that the present invention eliminates the alignment of the center of the inner diameter of the main body with the center of the threaded hole of the cover body. In other words, the process of making the stopper of the present invention is significantly simplified to result in a reduction in the production cost.

The component parts of the stopper of the present invention can be easily dismantled for cleaning or replacing the component parts. With a hand tool, the center rod can be easily rotated to become disengaged with the main body.

The stopper of the present invention works well in view of the washer which is under the pressure of the weight of the cover body and the pressure of water to become intimately to attached to the circular surface of the main body so as to avert the water leak.

The pull head of the stopper of the present invention is versatile in form and can be engaged with the cover body as desired.

The stopper of the present invention is simple in design and construction such that the cover body is caused to rise or descend along the center rod by rotating the cover body, and that the cover body is located by means of the bolt.

What is claimed is:

1. A sink drain stopper comprising:

a main body of a hollow construction and fastened with a sink, said main body provided in an underside thereof with a plurality of ribs and a threaded hole;

a center rod provided at one end thereof with a threaded portion engaged with said threaded hole of said main body, said center rod further provided at another end thereof with a slot, said center rod still further provided in an upper segment thereof with a position restricting slot and in a side thereof with a planar surface;

a cover body located on a top of said main body and provided in an underside thereof with an extension fastened therewith and provided with a stepped hole having in an upper section thereof an inner threaded hole, said cover body further provided with a locating slot extending from said extension to an inner bottom of said cover body, said extension provided in a side thereof with a threaded hole engaged with a bolt;

a washer provided with a through hole and retained in said locating slot of said cover body; and a pull head provided therein with a receiving cell and further provided in a bottom thereof with a threaded portion engaged with said stepped hole of said cover body.

* * * * *